US009694415B2

(12) United States Patent
Shan et al.

(10) Patent No.: US 9,694,415 B2
(45) Date of Patent: Jul. 4, 2017

(54) METHOD FOR MANUFACTURING MECHANICAL PARTS, AND MOLD AND SYSTEM THEREOF

(71) Applicant: ADVANCED MANUFACTURE TECHNOLOGY CENTER, CHINA ACADEMY OF MACHINERY SCIENCE AND TECHNOLOGY, Beijing (CN)

(72) Inventors: Zhongde Shan, Beijing (CN); Chao Jiang, Beijing (CN); Milan Zhang, Beijing (CN); Wanhua Cai, Beijing (CN); Yongsheng Ye, Beijing (CN)

(73) Assignee: Advanced Manufacture Technology Center, China Academy of Machinery Science & Technology, Beijing (CN)

( * ) Notice: Subject to any disclaimer, the term of this patent is extended or adjusted under 35 U.S.C. 154(b) by 376 days.

(21) Appl. No.: 14/357,734

(22) PCT Filed: Dec. 31, 2012

(86) PCT No.: PCT/CN2012/088021
§ 371 (c)(1),
(2) Date: May 12, 2014

(87) PCT Pub. No.: WO2014/067218
PCT Pub. Date: May 8, 2014

(65) Prior Publication Data

US 2014/0261920 A1 Sep. 18, 2014

(30) Foreign Application Priority Data

Oct. 31, 2012 (CN) ..... 2012 1 0367258

(51) Int. Cl.
*B21D 37/10* (2006.01)
*B21D 53/36* (2006.01)
(Continued)

(52) U.S. Cl.
CPC ..... *B21D 53/36* (2013.01); *B21D 22/022* (2013.01); *B21D 37/10* (2013.01); *B21D 37/16* (2013.01); *C21D 8/005* (2013.01)

(58) Field of Classification Search
None
See application file for complete search history.

(56) References Cited

U.S. PATENT DOCUMENTS 2,805,054 A * 9/1957 Hill ..... C21D 9/0025 266/130
2011/0037207 A1* 2/2011 Kim ..... C21D 1/18 266/115
2011/0272068 A1* 11/2011 Sunaga ..... B21D 13/10 148/653

FOREIGN PATENT DOCUMENTS

CN 2510195 Y 9/2002
CN 101439376 A 5/2009
(Continued)

OTHER PUBLICATIONS

*"Selection of Clearance of Square Part Drawing Die"* Lin Mousen, Machinery Workers Magazine, Ninth Issue, Sep. 1984, pp. 5-7.
(Continued)

*Primary Examiner* — Colleen Dunn
(74) *Attorney, Agent, or Firm* — Patterson Thuente Pedersen, P.A.

(57) ABSTRACT

A method for manufacturing a mechanical part by hot stamping, and a mold and a system thereof. The method includes: heating a steel plate blank at a predetermined heating temperature; and placing the steel plate blank into a mold of the mechanical part, and stamping the steel plate blank to form wrinkles at a rounded corner of the mold and form the mechanical part in the mold: wherein, the mold of the mechanical part includes a female mold and a male mold, a stamping gap configured to accommodate the steel
(Continued)

plate blank is provided between the female mold and the male mold, and a width of the stamping gap at the rounded corner of the mold is larger than a thickness of the wrinkles.

8 Claims, 7 Drawing Sheets

(51) Int. Cl.

| | |
|---|---|
| ***B21D 22/02*** | (2006.01) |
| ***B21D 37/16*** | (2006.01) |
| ***C21D 8/00*** | (2006.01) |

(56) References Cited

FOREIGN PATENT DOCUMENTS

| | | |
|---|---|---|
| CN | 102172719 | 9/2011 |
| JP | 60061122 A | 4/1985 |
| JP | 62103220 A | 1/1987 |

OTHER PUBLICATIONS

*"Microstructure and properties of hot stamping 22MnB5 steel"*, Jiang, Chao et al., Transactions of Materials and Heat Treatment, vol. 33, No. 3, Mar. 2012, 1 pg.

Chinese Office Action for Application No. 201210594172.7, issue date Mar. 13, 2015, 9 pgs., and English Summary of same Chinese Office Action, 1 pg.

Liu, Guobei, "Determination of Clearance at Round Corners of Drawing Die for Rectangular Part," Machinery Manufacturing, Aug. 31, 1993, English Translation included, 3 pgs.

Chen, Chang/an; Design of drawing die for thick plates, 1995. No. 5, 171, (230022), 1994-2014 China Academic Journal Electronic Publishing House http://www.cnki.net (pp. 15-16).

Liu, Guobei, "Determination of Clearance at Round Corners of Drawing Die for Rectangluar Part" (200240), 1994-2014 China Academic Journal Electronic Publishing House http://www.cnki.net (p. 23).

* cited by examiner

METHOD FOR MANUFACTURING MECHANICAL PARTS, AND MOLD AND SYSTEM THEREOF

PRIORITY CLAIM

The present application is a National Phase entry of PCT Application No. PCT/CN2012/088021, titled "METHOD FOR MANUFACTURING MECHANICAL PARTS, AND MOLD AND SYSTEM THEREOF, filed on Dec. 31, 2012, which claims the benefit of priority to Chinese Patent Application No. 201210367258.6 titled "HOT FORMING METHOD FOR GUIDING FAVORABLE DISTRIBUTION OF WRINKLES", filed with the Chinese State Intellectual Property Office on Oct. 31 2012, both of which applications are incorporated herein in their entireties by reference.

TECHNICAL FIELD

The present application relates to the filed of mechanical parts manufacture, in particular to a method for manufacturing mechanical parts, and a mold and a system thereof.

BACKGROUND

Energy saving, environment protection and safety become the development directions of the mechanical manufacture industry with the aggravation of worldwide energy crisis and environment problem, thus it is required to improve the utilization of the steel resource and reduce the consumption of the steel resource during the machinery manufacturing process.

A cold stamping process is generally employed for manufacturing various mechanical parts, wherein, a steel plate as a blank is pressed into a gap of a mold for manufacturing a mechanical part under the normal temperature, thus the steel plate is shaped in the mold to make the mechanical part. Generally, most of the mechanical parts, such as bracket parts as an electrical machine bracket, and disc parts, have multiple bent portions, and the bent portions are generally treated to rounded corners. However, the steel plate has a small ductility under the normal temperature, in this case, during the process of manufacturing the mechanical parts with the existing cold stamping process, the steel plate is hard to pass through the rounded corner since the steel plate is hard to bend when being stamped to the rounded corner in the gap of the mold, thus the one-step forming, i.e., directly forming the whole part by pressing one piece of steel plate into the entire gap of the mold, can not be realized by using the cold stamping process. Thus, in the process for manufacturing the mechanical part by cold stamping, a manner of multiple-steps forming and welding is generally employed, that is, portions, without a rounded corner, of the part are formed by stamping separately, and then these portions are welded together to form the whole part. Reference is made to FIG. 1, which shows an electrical machine bracket manufactured by cold stamping and welding. During the welding process, portions of the part to be welded together are required to have overlapped portions therebetween, thus when the mechanical parts is manufactured in the manner of multiple-steps forming and welding using the cold stamping, more steel plate materials may be consumed.

At present, in order to avoid the problem of high consumption of steel plate materials caused by using the cold stamping process, a hot stamping process may be employed to manufacture the mechanical parts. In the hot stamping process, a steel plate as a blank is heated, and the heated steel plate is pressed into the mold of the part when the steel plate is at a high temperature, thereby forming the mechanical part. The steel plate at a high temperature has a good ductility, thus during the stamping process, the steel plate is apt to be deformed to pass through the gap at the rounded corner, thus the one-step forming, i.e., directly forming the whole part by pressing one piece of steel plate into the mold, can be realized by using the hot stamping, thereby reducing the consumption of the steel resources during the manufacturing process of the mechanical parts. However, during the hot stamping process, when being passed through the gap at the rounded corner of the mold, the steel plate may subject to a resistance force to generate wrinkles, and wrinkles continually generated in the stamping process may be irregularly accumulated, and if the stamping process continues, the steel plate is apt to be cracked at the wrinkles. Thus, cracked parts are apt to be generated by using the hot stamping process to manufacture the mechanical parts, and the cracked parts are useless, which increases a rejection rate, and not only increases the production cost, but also causes a waste of the steel resources.

SUMMARY

The present application provides a method for manufacturing mechanical parts, and a mold and a system thereof, so as to overcome the defects in the prior art of the production of a large amount of cracked parts since wrinkles generated in the hot stamping process are apt to be cracked, the increased rejection rate, the increased production cost, and the waste of the steel resources.

A mold for manufacturing a mechanical part is provided in the present application, which includes a female mold and a male mold; a stamping gap configured to accommodate a steel plate blank is provided between the female mold and the male mold; and a width of the stamping gap at a rounded corner of the mold is larger than a thickness of wrinkles at the rounded corner of the mold.

Preferably, the width of the stamping gap at the rounded corner of the mold is a product of a setting coefficient times a thickness of the steel plate blank, and the setting coefficient is ranged from 1.15 to 2.255.

Preferably, a cooling system is provided on the mold.

Preferably, the mechanical part is an electrical machine bracket.

A method for manufacturing the mechanical part is further provided in the present application, which includes:

heating a steel plate blank at a predetermined heating temperature; and placing the steel plate blank into a mold of the mechanical part, and stamping the steel plate blank to form wrinkles at a rounded corner of the mold and form the mechanical part in the mold; wherein, the mold of the mechanical part includes a female mold and a male mold, a stamping gap configured to accommodate the steel plate blank is provided between the female mold and the male mold, and a width of the stamping gap at the rounded corner of the mold is larger than a thickness of the wrinkles.

Preferably, the width of the stamping gap at the rounded corner of the mold is a product of a setting coefficient times a thickness of the steel plate blank, and the setting coefficient is ranged from 1.15 to 2.25.

Preferably, the heating a steel plate blank in a predetermined heating temperature includes:

placing the steel plate blank in a heating furnace filled with nitrogen, heating the steel plate blank to an austenitizing temperature thereof, and preserving the heat of the steel plate blank in a case that the steel plate blank reaches the austenitizing temperature thereof Preferably, after forming the mechanical part, the method further includes:

cooling the mechanical part in the mold, wherein the mold has a cooling system; and taking the mechanical part out of the mold after a first time elapses and air-cooling the mechanical part.

Preferably, the mechanical part is an electrical machine bracket.

A control system for manufacturing the mechanical part is further provided in the present application, which includes:

a heating control unit, configured to heat a steel plate blank at a predetermined heating temperature; and a forming control unit, configured to place the steel plate blank into a mold of the mechanical part, and stamp the steel plate blank to form wrinkles at a rounded corner of the mold and form the mechanical part in the mold; and wherein the mold of the mechanical part comprises a female mold and a male mold, a stamping gap configured to accommodate the steel plate blank is provided between the female mold and the male mold, and a width of the stamping gap at the rounded corner of the mold is larger than a thickness of the wrinkles.

Preferably, the control system further includes:

a cooling control unit, configured to cool the mechanical part in the mold, and the mold has a cooling system; and an air-cooling control unit, configured to take the mechanical part out of the mold after a first time elapses and air-cool the mechanical part.

The present application has the following beneficial effects.

According to the technical solution of the present application, the mechanical part is manufactured by the hot stamping process, and a steel plate blank is heated and then is quickly placed into the mold of the mechanical part to be stamped. A stamping gap is provided between a female mold and a male mold, and since a width of the stamping gap at the rounded corner of the mold is larger than a thickness of wrinkles formed at the rounded corner from the steel plate blank, in the stamping process wrinkles generated at the rounded corner of the mold accumulated by layers, and in this case, the stamping gap will not be blocked by irregular wrinkles, and the stamping process of the steel plate blank will not be impeded, thus the steel plate blank will not be cracked during the whole stamping process of the mechanical part, thereby reducing the number of cracked products, lowering the rejection rate of the products, and further reducing the production cost and the consumption of steel resources.

Furthermore, since the width of the stamping gap is larger than the thickness of the wrinkles, the wrinkles accumulated in the stamping gap of the mold may be accumulated by layers under the effect of stamping. Since the steel plate blank is at a high temperature, the wrinkles accumulated by layers may be pressed to be smooth due to the good ductility of the steel plate blank, thus the wrinkles at the rounded corner of the mechanical part may be significantly reduced, and a thickness of the mechanical part at the rounded corner may be increased, thereby improving a tensile strength of the mechanical part.

DETAILED DESCRIPTION

Preferable implementation solutions of the present application will be described in detail hereinafter in conjunction with drawings and embodiments. It should be noted that, the meanings of terms, wordings and claims in the present application are not limited to the literal and normal meanings, but also include meanings and concepts consistent with the technology of the present application. In order to describe the invention most properly, it is required to define the terms appropriately. Thus, configurations provided in the specification and drawings are only preferable implementation solutions, and are not intended to list all the technical features of the present application. It should be noted that, the solutions described herein may be replaced by various equivalence solutions or modified solutions.

Figure 2:
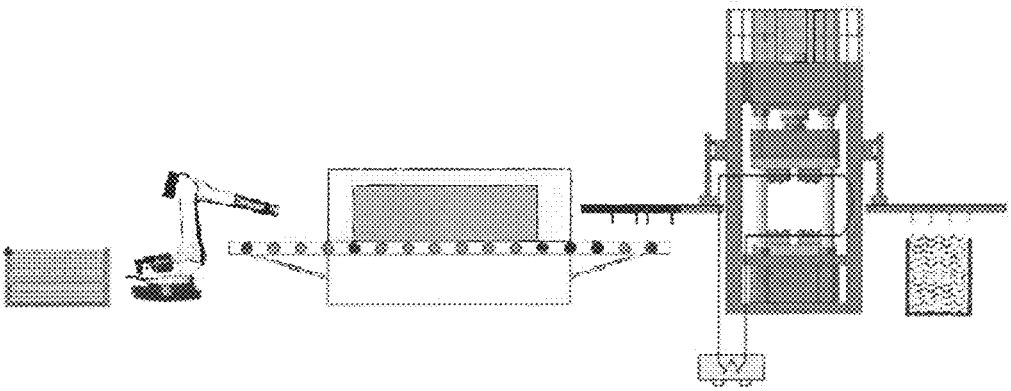
Figure 2 (Prior Art)
FIG. 2 is a schematic view of an existing hot stamping processing system in which the present application may be applied.

The present application is adapted to the manufacturing process of various mechanical parts, in particular to a process of manufacturing a mechanical part with a rounded corner, such as bracket parts for example an electrical machine bracket, and disc parts. The present application may be directly applied in an existing hot stamping processing system as shown in FIG. 2.

Since the manner of cold stamping and welding is still the main manufacturing method of the mechanical parts, for molds of various parts, a width of a gap of the mold is slightly larger than a thickness of the steel plate to ensure the steel plate has exactly the same structure as that of the mold during the cold stamping process, which may prevent a part, having a shape different from that of the gap, being formed due to the shake of the steel plate in the cold stamping process. However, for the hot stamping process, the steel plate has a good ductility under a high temperature, and wrinkles may also be generated during the stamping process.

In view of the above situation, the present application provides the following solutions. The mold of the mechanical part is improved by utilizing the better ductility of the steel plate under a high temperature in the hot stamping process, thus, wrinkles generated by the steel plate having a high temperature in the stamping process may be accumulated by layers in the gap of the mold, thereby avoiding cracks caused by the stamping of the steel plate being impeded by an irregular accumulation of wrinkles, and at the same time, the wrinkles accumulated by layers may become smooth, thereby reducing irregular wrinkles on the surface of the manufactured part.

Implementation manners of a method for manufacturing a mechanical part, and a mold and a system thereof according to the present application will be described in detail hereinafter in conjunction with drawings and embodiments.

Figure 3:
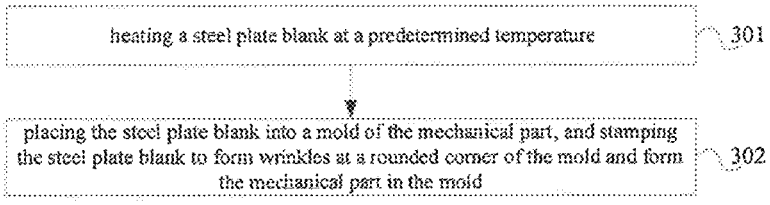
FIG. 3 is a flow chart of a first embodiment of a method for manufacturing a mechanical part according to the present application.

Reference is made to FIG. 3, which is a flow chart of a first embodiment of a method for manufacturing a mechanical part according to the present application. In this embodiment, the mechanical part is manufactured by hot stamping, and the mechanical part may be an electrical machine bracket or other mechanical parts. The method includes a step 301 and a step 302.

The step 301 is to heat a steel plate blank at a predetermined heating temperature.

The steel plate blank is placed in a heating furnace in a hot stamping processing system. Since it is generally required to heat the steel plate to a temperature above its austenitizing temperature in the hot stamping process, the predetermined heating temperature is normally not lower than 700 degree Celsius. In this situation, protection gas, such as nitrogen, may be filled in the heating furnace to protect the steel plate from being oxidized in the heating process. The step 301 may includes: placing the steel plate blank in the heating furnace filled with nitrogen, heating the steel plate blank to its austenitizing temperature, and preserving the heat of the steel plate blank when it reaches the austenitizing temperature. Preferably, the steel plate blank is heated to a temperature of 10 to 50 degree Celsius above the austenitizing temperature, and the time of heat preservation is preferably set as 5 minutes.

It should be noted that, different steel plate blanks have different austenitizing temperatures, thus the predetermined heating temperature of the heating furnace is based on the used steel plate blank. The austenitizing temperature of the steel plate blank is related to the components thereof.

The step 302 is to place the steel plate blank into a mold of the mechanical part, and stamp the steel plate blank to form wrinkles at a rounded corner of the mold and form the mechanical part in the mold. The mold of the mechanical part includes a female mold and a male mold, a stamping gap configured to accommodate the steel plate blank is provided between the female mold and the male mold, and a width of the stamping gap at the rounded corner of the mold is larger than a thickness of the wrinkles.

The mold of the mechanical part in this embodiment includes a female mold and a male mold which are substantially identical in shape to each other. After the female mold and the male mold are assembled together, a stamping gap will be formed between the female mold and the male mold, and the steel plate blank is stretched and pressed in the stamping gap to be formed.

In order to ensure that the wrinkles formed, from the steel plate blank, at the rounded corner of the stamping gap are accumulated by layers regularly, the width of the stamping gap at the rounded corner is required to be larger than the thickness of the wrinkles, and the thickness of the wrinkles is related to a thickness of the steel plate blank. A preferred setting rule of the width of the stamping gap at the rounded corner of the mold is provided in this embodiment, that is, the width of the stamping gap at the rounded corner of the mold is set as a product of a setting coefficient times the thickness of the steel plate blank, and the setting coefficient is ranged from 1.15 to 2.25.

According to the technical solution in this embodiment, since the width of the stamping gap at the rounded corner of the mold is set to be larger than the thickness of the wrinkles formed from the steel plate blank, the wrinkles may be accumulated by layers in the stamping gap at the rounded corner, thereby forming regular wrinkles. In this case, cracks at the wrinkles caused by the irregular accumulation of the wrinkles when the steel plate blank is further stamped may be prevented, thereby reducing the number of cracked products in the manufacturing process of mechanical parts, lowering the rejection rate of the products, and further reducing the production cost and the consumption of steel resources.

Figure 1:
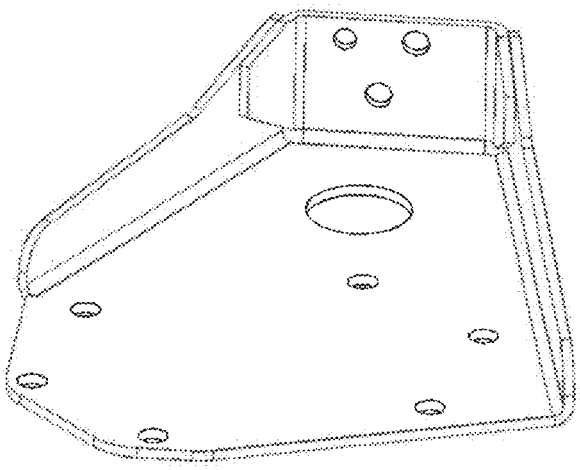
Figure 1 (Prior Art)
FIG. 1 is a schematic view of an electrical machine bracket manufactured by cold stamping and welding in the prior art.
Figure 4:
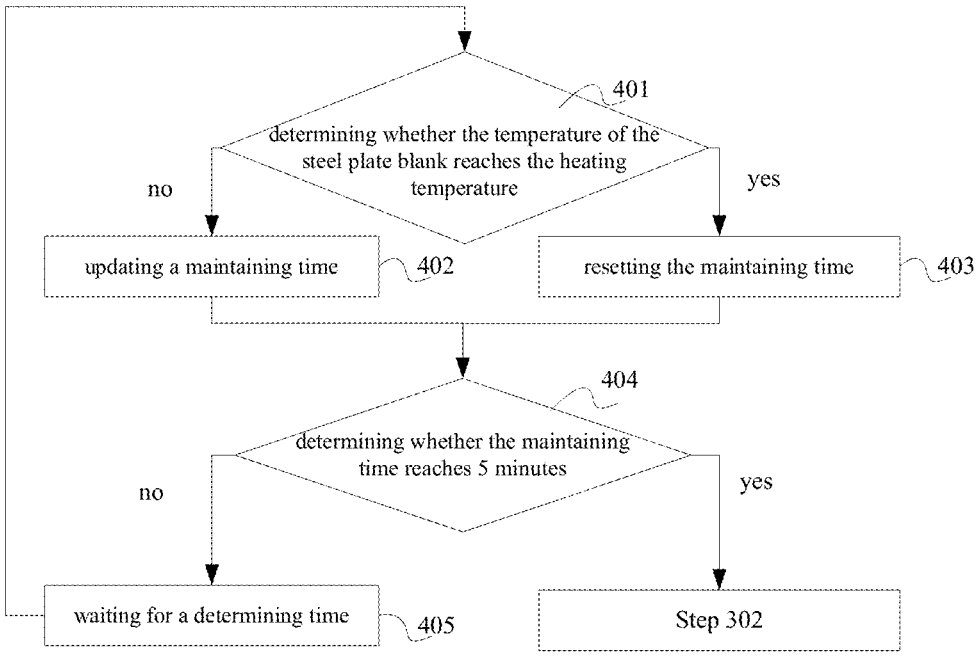
FIG. 4 is a flow chart of a second embodiment of a method for manufacturing a mechanical part according to the present application.

Reference is made to FIG. 4, which is a flow chart of a second embodiment of a method for manufacturing the mechanical part according to the present application. Based on the first embodiment of the method shown in FIG. 1, this embodiment further includes steps 401 to 405 after the step 301.

The step 401 is to determine whether a temperature of the steel plate blank reaches the heating temperature; and if the temperature of the steel plate blank reaches the heating temperature, the procedure proceeds to the step 402, and if the temperature of the steel plate blank does not reach the heating temperature, the procedure proceeds to the step 403.

The heating temperature may be a temperature of 10 to 20 degree Celsius above the austenitizing temperature of the steel plate blank.

It could be understood that, it's required to monitor the temperature of the steel plate blank before performing the step 401, and the existing heating furnace of the hot stamping system generally has a device for detecting the temperature of the steel plate blank, thus will not be described herein.

The step 402 is to update a maintaining time, and then the procedure proceeds to the step 404.

The step 403 is to reset the maintaining time and then the procedure proceeds to the step 404.

It could be understood that, after the step 503 is finished, the procedure may not proceed to the step 404, but return to proceed to the step 401 after a certain time elapses.

The step 404 is to determine whether the maintaining time reaches 5 minutes; if the maintaining time does not reach 5 minutes, the procedure proceeds to the step 405, and if the maintaining time reaches 5 minutes, the procedure proceeds to the step 302.

It could be understood that, after the procedure proceeds to the step 302 when the maintaining time reaches 5 minutes, it is required to reset the maintaining time to ensure the monitoring of a heating process of a next steel plate blank.

The step 405 is to wait for a first time, and then the procedure returns to proceed to the step 401.

Unlike the first embodiment of the method shown in FIG. 3, this embodiment may monitor the heating condition of the steel plate blank, and only the steel plate blank meeting the predetermined heating condition is pressed, thereby ensuring an implementation of the press forming in the hot stamping, and reducing the number of substandard products.

Figure 5:
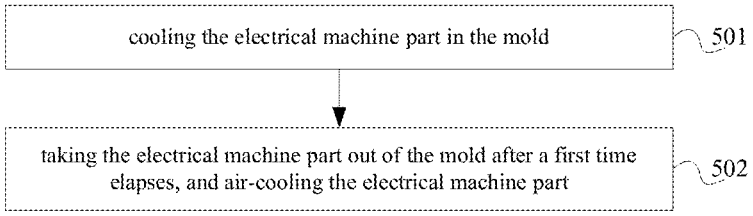
FIG. 5 is a flow chart of a third embodiment of a method for manufacturing a mechanical part according to the present application.

Reference is made to FIG. 5, which is a flow chart of a third embodiment of a method for manufacturing the mechanical part according to the present application. Based on the first embodiment of the method shown in FIG. 3, this embodiment further includes a step 501 and a step 502 after the step 302.

The step 501 is to cool the mechanical part in the mold. The mold has a cooling system.

The steel plate blank has a high temperature during the hot stamping process, thus after the mechanical part is formed in the mold, it is required to cool the mechanical part.

During the hot stamping, the temperature of the steel plate may generally reach the austenitizing temperature thereof, thus the mechanical part tends to form a martensitic structure steel structure by the cooling process after the hot stamping process. Steel products with the martensitic structure steel structure are ultra-high-strength steel parts, which are able to bear higher stress intensity in using. Thus, the mechanical part with the martensitic structure steel structure can bear larger pushing force or pulling force.

During the cooling process, a cooling system may be directly installed in the mold. A cooling speed of the mechanical part in the cooling system should be above 15/s.

The step 502 is to take the mechanical part out of the mold after the first time elapses and air-cool the mechanical part.

The determination of the first time is required to meet the condition that the martensitic structure of the entire mechanical part may be formed after the first time elapses.

Unlike the first embodiment of the method shown in FIG. 3, in this embodiment, during the cooling process, the entire mechanical part is firstly cooled in the mold until the martensitic structure is formed, and then is taken out for air cooling. In this way, both the forming process and the strength enhancing process of the mechanical part may be completed in one stamping forming process, which may not only improve the strength of the mechanical part, but also simplify the manufacturing processes of products, thereby saving the manufacturing time and the manufacturing cost.

Figure 6:
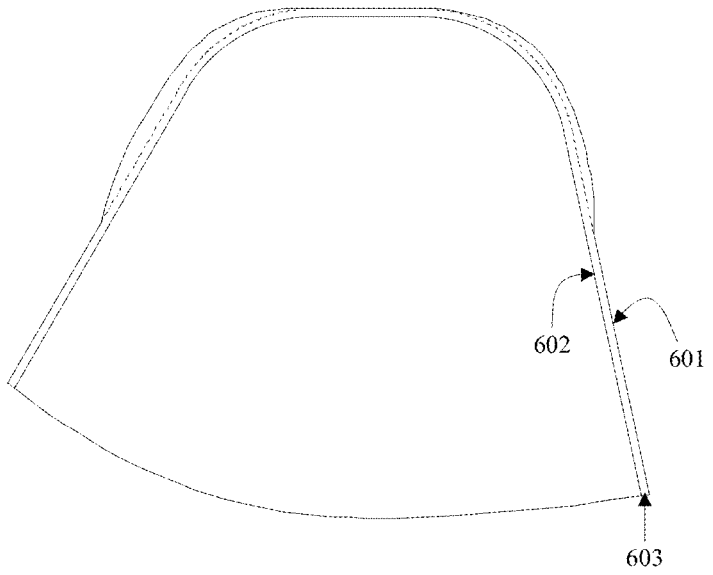
FIG. 6 is a top structural view of a first embodiment of a mold for manufacturing a mechanical part according to the present application.

To achieve the embodiments of the method according to the present application, the present application further provides a mold for manufacturing the mechanical part. Reference is made to FIG. 6, which is a top structural view of the first embodiment of the mold for manufacturing the mechanical part according to the present application. This embodiment is adapted to the method for manufacturing the mechanical part using the hot stamping process, and the mechanical part may be an electrical machine bracket or other mechanical parts. The mold of the mechanical part includes a female mold 601 and a male mold 602, a stamping gap 603 configured to accommodate the steel plate blank is provided between the female mold 601 and the male mold 602, and a width of the stamping gap 603 at the rounded corner of the mold is larger than a thickness of the wrinkles.

In FIG. 6, solid lines indicate visible portions of the female mold 601 and the male mold 602 of the mold in this embodiment in a top view, and dotted lines indicate portions of a female mold 604 used in the existing mold that are not overlapped with the female mold 601 of the mold in this embodiment.

Preferably, the width of the stamping gap 603 at the rounded corner of the mold is set as a product of a setting coefficient times a thickness of the steel plate blank, and the setting coefficient is ranged from 1.15 to 2.25.

Preferably, the mold has a cooling system, a cooling temperature of the cooling system is set according to various steel plate blanks and heating temperatures thereof, and a cooling speed of the formed mechanical part is required to be above 15/s.

The hot stamp forming of the mechanical part is realized by using the mold of this embodiment, in this way, cracks at the wrinkles caused by the irregular accumulation of the wrinkles when the steel plate blank is further stamped may be prevented, thereby reducing the number of cracked products in the manufacturing process, lowering the rejection rate of the products, and further reducing the production cost and the consumption of steel resources.

Figure 7:
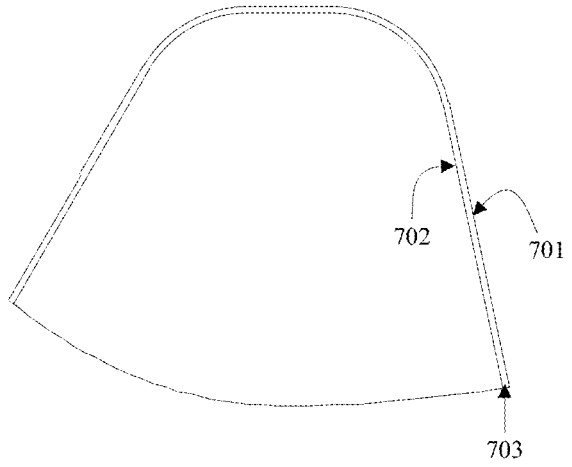
FIG. 7 is a top structural view of a mold used in a first embodiment of an application according to the present application.

It should be noted that, for those skilled in the art to fully understand the technical solution of the embodiment, a structural view of the mold according this embodiment is shown in FIG. 7 by taking a mold of an electrical machine bracket as an example. However, for those skilled in the art, it should be understood that, the mold according to this embodiment should not be limited to the mold of the electrical machine bracket, but also may be molds of various bracket parts and various disc parts in the electrical machine, including the electrical machine bracket.

For those skilled in the art to more clearly understand the technical effects of the embodiments of the method and the mold for manufacturing the mechanical part according to the present application, a product of a mechanical part manufactured by the technical solution in the prior art and a product of a mechanical part manufactured by the technical solution of the embodiments of the present application are compared in embodiments of an application of processing test. The following embodiments of the application are described by taking the electrical machine bracket as an example, and all employ the same hot stamping processing system and the same steel plate blank.

Figure 8:
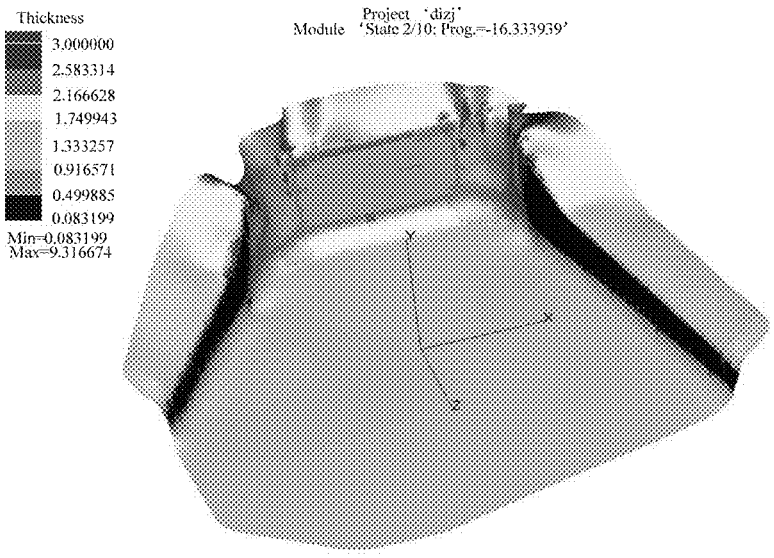
FIG. 8 is a schematic view of an electrical machine bracket formed in the first embodiment of the application according to the present application.

A first embodiment of the application is to manufacture an electrical machine bracket by the hot stamping process in the prior art, and a mold employed is shown in FIG. 7 and includes a female mold 701 and a male mold 702, and a stamping gap 703 is provided between the female mold 701 and the male mold 702. The hot stamping process includes: heating the steel plate blank to a temperature of 950 degree Celsius, and preserving the heat of the steel plate blank for 5 minutes, then placing the steel plate blank into the mold as shown in FIG. 7 to form a mechanical part. Reference is made to FIG. 8, which shows the electrical machine bracket formed according to this embodiment. As shown in FIG. 8, the rounded corners of the mechanical part have clear cracks.

Figure 9:
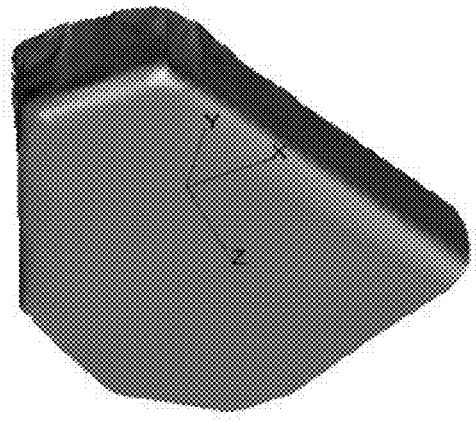
FIG. 9 is a schematic view of an electrical machine bracket formed in a second embodiment of the application according to the present application.

A second embodiment of the application is to manufacture an electrical machine bracket by employing the technical solution of the first embodiment of the method according to the present application, and the mold employed is shown in FIG. 6. The hot stamping process includes: heating the steel plate blank to a temperature of 950 degree Celsius, and preserving the heat of the steel plate blank for 5 minutes, then placing the steel plate blank into the mold as shown in FIG. 6 to form a mechanical part. Reference is made to FIG. 9, which shows the mechanical part formed according to this embodiment. As shown in FIG. 9, the rounded corners of the mechanical part have no cracks and no clear irregular wrinkles.

Based on the first embodiment and the second embodiment of the application, compared with the prior art, cracks may be avoided and irregular wrinkles may be reduced by employing the technical solution of the first embodiment of the method and the technical solution of the first embodiment of the mold according to the present application.

Figure 10:
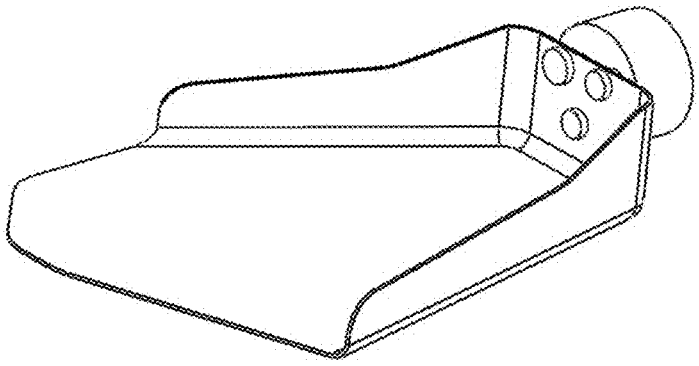
FIG. 10 is a schematic view of tensile tests conducted in a third embodiment and a fourth embodiment of the application according to the present application.
Figure 11:
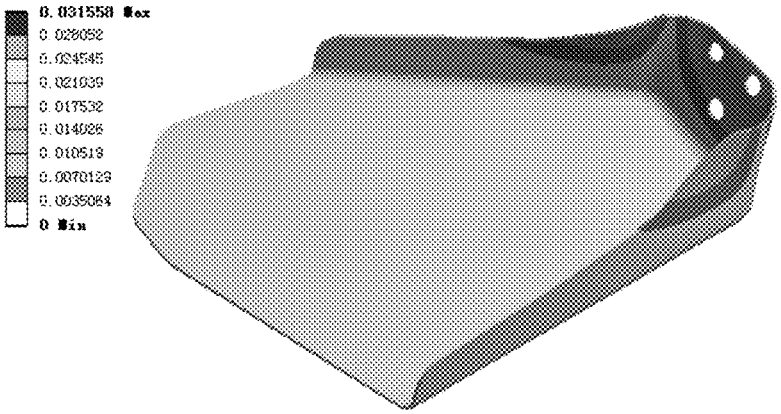
FIG. 11 is a schematic view of an electrical machine bracket after being pulled in the third embodiment of the application according to the present application.

A third embodiment of the application is to conduct a tensile test on the electrical machine bracket formed according to the first embodiment of the application, and the mold employed is shown in FIG. 7. The tensile test is shown in FIG. 10, and a value of the tensile force is 45 KN. The electrical machine bracket after being pulled is shown in FIG. 11, and the measured maximum value of a deformation of the electrical machine bracket reaches $3.16\times10^{-2}$ mm.

Figure 12:
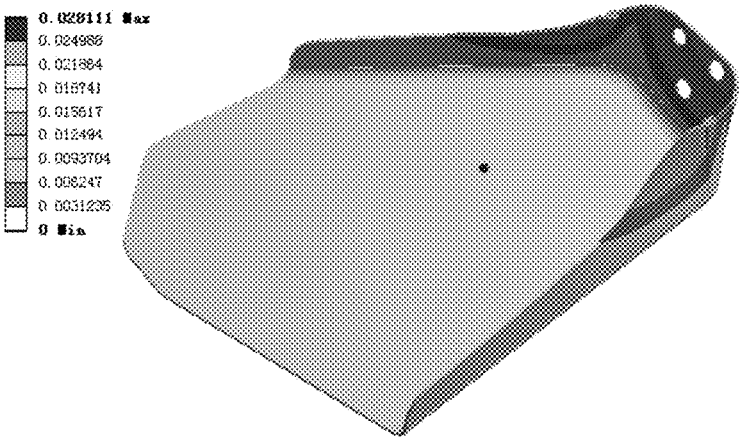
FIG. 12 is a schematic view of an electrical machine bracket after being pulled in the fourth embodiment of the application according to the present application.

A fourth embodiment of the application is to conduct a tensile test on the electrical machine bracket formed according to the second embodiment of the application, and the mold employed is shown in FIG. 6. The tensile test is also shown in FIG. 10, and a value of the tensile force is also 45 KN. The electrical machine bracket after being pulled is shown in FIG. 12, and the measured maximum value of a deformation of the electrical machine bracket reaches $3.16\times10^{-2}$ mm.

Based on the third embodiment and the fourth embodiment of the application, compared with the prior art, the electrical machine bracket, formed by employing the technical solution of the first embodiment of the method and the technical solution of the first embodiment of the mold according to the present application, has a smaller deformation under the same tensile force, thus, the mechanical part manufactured according to the present application has a better tensile ability.

Figure 13:
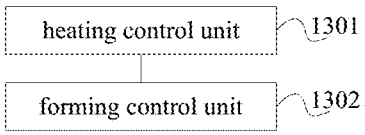
FIG. 13 is a structural diagram of a first embodiment of a control system for manufacturing a mechanical part according to the present application.

The present application further provides a control system for manufacturing the mechanical part corresponding to the embodiments of the method. Reference is made to FIG. 13, which is a structural diagram of a first embodiment of a control system for manufacturing a mechanical part according to the present application. This embodiment may be applied in the method for manufacturing the mechanical part by the hot stamping process. The system includes:

- a heating control unit 1301, configured to heat the steel plate blank at a predetermined heating temperature; and
- a forming control unit 1302, configured to place the steel plate blank into a mold of the mechanical part, and stamp the steel plate blank to form wrinkles at a rounded corner of the mold and form the mechanical part in the mold. The mold of the mechanical part includes a female mold and a male mold, a stamping gap configured to accommodate the steel plate blank is provided between the female mold and the male mold, and a width of the stamping gap at the rounded corner of the mold is larger than a thickness of the wrinkles.

Figure 14:
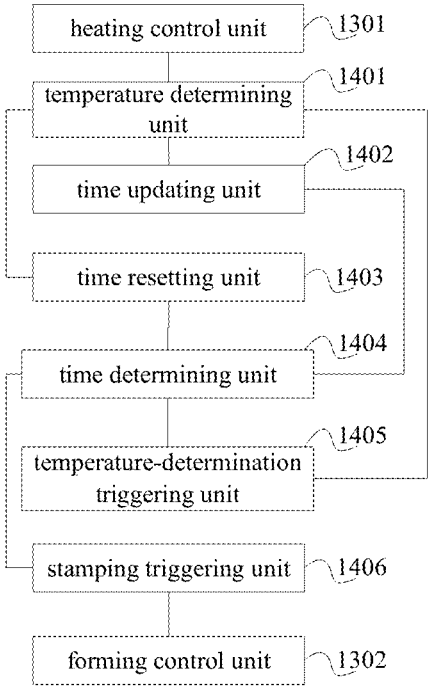
FIG. 14 is a structural diagram of a second embodiment of a control system for manufacturing a mechanical part according to the present application.
Figure 15:
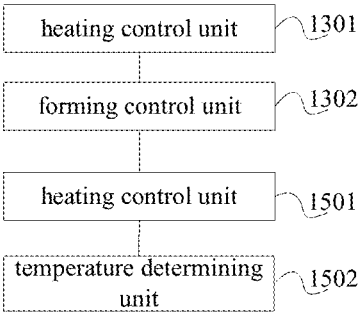
FIG. 15 is a structural diagram of a third embodiment of a control system for manufacturing a mechanical part according to the present application.

Reference is made to FIG. 14, which is a structural diagram of a second embodiment of a control system for manufacturing a mechanical part according to the present application. Besides all the structures of the first embodiment of the system according to the present application, this embodiment may further include:

- a temperature determining unit 1401, configured to determine whether a temperature of the steel plate blank is above an austenitizing temperature thereof;
- a time updating unit 1402, configured to update a maintaining time in a case that the temperature determining unit 1401 determines that the temperature of the steel plate blank is above the austenitizing temperature thereof;
- a time resetting unit 1403, configured to reset the maintaining time in a case that the temperature determining unit 1401 determines that the temperature of the steel plate blank is not above the austenitizing temperature thereof;
- a time determining unit 1404, configured to determine whether the maintaining time reaches 5 minutes;
- a temperature-determination triggering unit 1405, configured to trigger the temperature determining unit 1401 after a first time elapses in a case that the temperature determining unit 1401 determines that the temperature of the steel plate blank is not above the austenitizing temperature thereof; and
- a stamping triggering unit 1406, configured to trigger a forming unit 1302 in a case that the temperature determining unit 1401 determines that the temperature of the steel plate blank is not above the austenitizing temperature thereof Reference is made to FIG. 15, which is a structural diagram of a third embodiment of a control system for manufacturing a mechanical part according to the present application. Besides all the structures of the first embodiment of the system according to the present application, this embodiment may further include:

- a cooling control unit 1501, configured to cool the mechanical part in the mold, and the mold has a cooling system; and
- an air-cooling control unit 1502, configured to take the mechanical part out of the mold after the first time elapses and air-cool the mechanical part.

For the mechanical part manufactured according to the embodiment of the system in the present application, cracks at the wrinkles caused by the irregular accumulation of the wrinkles when the steel plate blank is further stamped may be prevented, thereby reducing the number of cracked products in the manufacturing process, lowering the rejection rate of the products, and further reducing the production cost and the consumption of steel resources.

It should be noted that, herein, terms, like "first" and "second", are only used to distinguish one entity or operation from another entity or operation, and are not intended to require or imply an actual existence of such relationship or order between these entities or operations. Terms "comprising", "including" or any other variations thereof, are intended to cover a non-exclusive inclusion, such that each of the process, method, article or device including a series of elements includes not only those elements, but also includes other elements not explicitly listed, or includes inherent elements for such process, method, article or device. Without more constraints, an element defined by the statement "includes one . . . " does not exclude the existence of additional identical elements in the process, method, article, or device each having the element.

For the embodiments of the system, since it basically corresponds to the embodiments of the method, references may be made to the descriptions of the embodiments of the method with respect to the relevant portions among the embodiments of the system and the method. The embodiments of the system described hereinabove are only illustrative, wherein the unit described as a separating component may be or may not be physically separated, and the component shown as an unit may be or may not be a physical unit, i.e., it may be located at one place or may be distributed in multiple network units. A part or all of the modules may be selected to achieve the purpose of the solution of the embodiments according to actual needs. Based on the above description of the embodiments, the person skilled in the art is capable of understanding and carrying out the present application, without any creative efforts.

The above description is only embodiments of the present application. It should be noted that, for the person skilled in the art, several modifications and improvements may be made to the present application without departing from the principle of the present application, and these modifications and improvements are also deemed to fall into the protection scope of the present application.

The invention claimed is:

1. A method for manufacturing a mechanical part, comprising:

heating a steel plate blank at a predetermined heating temperature; and placing the steel plate blank into a mold of the mechanical part, and stamping the steel plate blank to form wrinkles at a rounded corner of the mold and form the mechanical part in the mold; wherein, the mold of the mechanical part comprises a female mold and a male mold, a stamping gap configured to accommodate the steel plate blank is provided between the female mold and the male mold, and a width of the stamping gap at the rounded corner of the mold is larger than a thickness of the wrinkles, to allow wrinkles formed, from the steel plate blank, at the rounded corner of the stamping gap to be accumulated by layers regularly.

2. The method according to claim 1, wherein the width of the stamping gap at the rounded corner of the mold is a product of a setting coefficient times a thickness of the steel plate blank, and the setting coefficient is ranged from 1.15 to 2.25.

3. The method according to claim 1, wherein the heating a steel plate blank in a predetermined heating temperature comprises:

placing the steel plate blank in a heating furnace filled with nitrogen, heating the steel plate blank to an austenitizing temperature thereof, and preserving the heat of the steel plate blank in a case that the steel plate blank reaches the austenitizing temperature thereof.

4. The method according to claim 1, wherein after forming the mechanical part, the method further comprises:

cooling the mechanical part in the mold, wherein the mold has a cooling system; and taking the mechanical part out of the mold after a first time elapses and air-cooling the mechanical part.

5. The method according to claim 1, wherein the mechanical part is an electrical machine bracket.

6. The method according to claim 2, wherein the mechanical part is an electrical machine bracket.

7. The method according to claim 3, wherein the mechanical part is an electrical machine bracket.

8. The method according to claim 4, wherein the mechanical part is an electrical machine bracket.

* * * * *